US010995514B2

(12) United States Patent
Xu et al.

(10) Patent No.: US 10,995,514 B2
(45) Date of Patent: May 4, 2021

(54) FOLDING TENT WITH CENTRAL SELF-LOCK STRUCTURE

(71) Applicant: ZHEJIANG JIANSHENG LEISURE PRODUCTS CO.,LTD, Zhejiang (CN)

(72) Inventors: Weijun Xu, Zhejiang (CN); Yuanru Sun, Zhejiang (CN); Jian He, Zhejiang (CN)

(73) Assignee: ZHEJIANG JIANSHENG LEISURE PRODUCTS CO., LTD, Zhejiang (CN)

( * ) Notice: Subject to any disclaimer, the term of this patent is extended or adjusted under 35 U.S.C. 154(b) by 0 days.

(21) Appl. No.: 16/690,146

(22) Filed: Nov. 21, 2019

(65) Prior Publication Data

US 2020/0181938 A1 Jun. 11, 2020

(30) Foreign Application Priority Data

Oct. 18, 2019 (CN) ..... 201910993942.7
Oct. 18, 2019 (CN) ..... 201921753695.5

(51) Int. Cl.
*E04H 15/46* (2006.01)
*E04H 15/50* (2006.01)

(52) U.S. Cl.
CPC ..... *E04H 15/46* (2013.01); *E04H 15/50* (2013.01)

(58) Field of Classification Search
CPC ..... E04H 15/46; E04H 15/50
USPC ..... 135/142, 145–147, 159
See application file for complete search history.

(56) References Cited

U.S. PATENT DOCUMENTS 4,607,656 A * 8/1986 Carter ..... E04H 15/50 135/122
5,275,188 A * 1/1994 Tsai ..... E04H 15/50 135/145
5,794,640 A * 8/1998 Jang ..... E04H 15/50 135/131
6,575,656 B2 * 6/2003 Suh ..... E04H 15/46 135/114
6,708,707 B2 * 3/2004 Dotterweich ..... E04H 15/50 135/131

(Continued)

FOREIGN PATENT DOCUMENTS

CA 2895981 A1 * 12/2015 ..... E04H 15/50
CN 204024196 12/2014

(Continued)

*Primary Examiner* — Robert Canfield
(74) *Attorney, Agent, or Firm* — JCIP Global Inc.

(57) ABSTRACT

A folding tent with central self-lock structure comprises a plurality of tent leg tubes, a plurality of side cross units, a plurality of middle cross units and at least one central self-lock mechanism. The central self-lock mechanism is configured to be installed in cooperation with one end of the middle cross units. The central self-lock mechanism includes a lock rod assembly, a self-lock unit, an upper disc member and a lower disc assembly. When the folding tent is in an unfolded state, the self-lock unit and the lock rod assembly are locked, and a spacing between the upper disc member and the lower disc assembly is the smallest; when the folding tent is in a retracted state, the self-lock unit and the lock rod assembly are unlocked, the lock rod assembly is telescopic, and the spacing between the upper disc member and the lower disc assembly increases with the retraction.

9 Claims, 14 Drawing Sheets

(56) References Cited

U.S. PATENT DOCUMENTS 6,929,017 B2 * 8/2005 Byun ..... E04H 15/50 135/131
7,066,676 B2 * 6/2006 Tsai ..... E04H 15/50 135/142
7,240,686 B2 * 7/2007 Seo ..... E04H 15/50 135/131
7,360,549 B2 * 4/2008 Seo ..... E04H 15/44 135/145
7,422,026 B2 * 9/2008 Kim ..... E04H 15/50 135/120.2
10,246,898 B2 * 4/2019 Jin ..... E04H 15/46
2002/0074032 A1 * 6/2002 Park ..... E04H 15/50 135/131
2003/0024563 A1 * 2/2003 Liu ..... E04H 15/50 135/131
2005/0241688 A1 * 11/2005 Wu ..... E04H 15/48 135/145
2006/0062632 A1 * 3/2006 Jang ..... E04H 15/46 403/109.6
2007/0012347 A1 * 1/2007 Ochi ..... E04H 15/50 135/145
2014/0030012 A1 * 1/2014 Lee ..... E04H 15/50 403/326
2015/0247339 A1 * 9/2015 Lee ..... E04H 15/50 135/145
2015/0308147 A1 * 10/2015 Lee ..... E04H 1/1205 135/145
2016/0348392 A1 * 12/2016 Jin ..... E04H 15/46
2018/0209167 A1 * 7/2018 Yang ..... E04H 15/48
2019/0234102 A1 * 8/2019 Lu ..... E04H 15/46
2019/0368232 A1 * 12/2019 Sun ..... F16B 21/18
2020/0181939 A1 * 6/2020 Ying ..... E04H 15/32
2020/0240168 A1 * 7/2020 Sun ..... E04H 15/50

FOREIGN PATENT DOCUMENTS

CN 204475966 7/2015
DE 202019106527 U1 * 12/2019 ..... E04H 15/46
DE 202020100309 U1 * 2/2020 ..... E04H 15/32

* cited by examiner

FOLDING TENT WITH CENTRAL SELF-LOCK STRUCTURE

CROSS-REFERENCE TO RELATED APPLICATION

This application claims the priority benefit of China application serial no. 201910993942.7 and no. 201921753695.5, filed on Oct. 18, 2019. The entirety of each of the above-mentioned patent applications is hereby incorporated by reference herein and made a part of this specification.

BACKGROUND

Technical Field

The present invention relates to the technical field of folding tents, in particular, to a folding tent with central self-lock structure.

Description of Related Art

The structure of the tent is various, and the tent used for outdoor sunshade may be usually divided in to a fixed-type tent and a folding tent. Due to a large size, the fixed-type tent is generally suitable for long-term fixed placement and is not suitable for carrying out. The folding tent alias an advertising tent or an awning, which can be used for outdoor exhibitions and product promotion, celebration evenings, exhibitions, tourism, leisure, field work, food stalls. However, the traditional folding tent usually has a locking buckle on the leg pole, and requires multiple people to complete the folding storage or deployment, which is cumbersome to operate.

To this end, more folding tents with central unlock structure have been developed today, such as, as disclosed in Chinese Patent No. CN204024196U, which discloses a tent with a single point-lock, comprising a leg tube that is located on an outside of a center tube, a cross tube that is composed of an outer cross tube and an inner cross tube, a center tube, and a slider. The adjacent leg tubes are hingedly connected by an X-shaped outer cross tube, and the leg tube is hingedly connected to the center tube by an X-shaped inner cross tube. The center tube is provided therein with a single-point locking buckle structure. Among them, the single-point locking buckle structure includes a first slider, a movable pin connecting block, a first movable pin, a link, a button block, a first center bottom cap, and a first center top cap. The center tube is provided with a locking buckle hole. A lower end tube of the center tube is provided with the button block, an upper end of the button block is connected to one end of the link, the other end of the link is connected to the movable pin connecting block, the movable pin connecting block is provided with a chute, and the other end of the link is embedded in the chute of the movable pin connecting block by a movable bolt and is connected to the movable pin connecting block. An upper end of the movable pin connecting block is connected with the first movable pin. An outside of the center tube is sleeved with the first slider, the first slider is provided with a round hole, and the first movable pin is embedded in the round hole of the first slider by the locking buckle hole of the center tube. However, this type of single-point lock structure is relatively complicated, and it needs to be integrated in the center tube, leading to higher product processing costs, and individual spare parts are prone to wear and tear during long-term use, resulting in improper use of the product and affecting performance.

SUMMARY

For the above problems, the disclosure aims to provide a folding tent with central self-lock structure, which has advantages of simple structure, convenient processing, low cost and good stability.

The technical problem solved by the present invention may be implemented by the following technical solutions.

A folding tent with central self-lock structure includes a plurality of tent leg tubes, a plurality of side cross units, a plurality of middle cross units and at least one central self-lock mechanism. The central self-lock mechanism is configured to be installed in cooperation with one end of the middle cross units. The central self-lock mechanism includes a lock rod assembly in a telescopic rod structure, a self-lock unit, an upper disc member and a lower disc assembly. When the folding tent is in an unfolded state, the self-lock unit and the lock rod assembly are locked, and a spacing between the upper disc member and the lower disc assembly is the smallest. When the folding tent is in a retracted state, the self-lock unit and the lock rod assembly are unlocked, the lock rod assembly is telescopic, and the spacing between the upper disc member and the lower disc assembly gradually increases with the retraction.

The lock rod assembly includes an outer lock rod, a first inner rod and a second inner rod. A lower portion of the outer lock rod is provided with a lock groove, and the first inner rod and the second inner rod may perform a telescopic movement relative to the outer lock rod.

An upper portion of the outer lock rod is fixedly mounted with the upper disc member.

The self-lock unit is configured to be mounted in cooperation with the lower disc assembly, and the self-lock unit includes a lock tab, a return spring, a driving pin and a trigger. The trigger is hingedly engaged with the lower disc assembly, and one end of the trigger is movable against the driving pin. An upper end of the driving pin is engaged with the lock tab, and the return spring is configured to act on the lock tab. The driving pin is hingedly engaged with the lower disc assembly.

The self-lock unit is configured to be mounted in cooperation with the lower disc assembly, and the self-lock unit includes a lock tab, a return spring, and a pressing plate. The pressing plate is hingedly engaged with the lower disc assembly, and one end of the pressing plate is movable against the lock tab after being pressed upward. The return spring is configured to act on the lock tab.

The self-lock unit is configured to be mounted in cooperation with the lower disc assembly, and the self-lock unit includes a lock tab, a return spring, and a triggering plate. The triggering plate is hingedly engaged with the lower disc assembly, and one end of the triggering plate is movable against the lock tab after being triggered downward. The return spring is configured to act on the lock tab.

The self-lock unit is configured to be mounted in cooperation with the lower disc assembly, and the self-lock unit includes a lock pin, a return spring and a holder. The return spring has one end in contact with the lock pin, and the other end in contact with the holder. The return spring is deformed as the lock pin moves, and the holder is fixedly mounted with the lower disc assembly. One end of the lock pin penetrates through the holder and extends to an outside of the lower disk assembly.

The self-lock unit is configured to be mounted in cooperation with the lock rod assembly, and the self-lock unit is an elastic member; the elastic member is mounted in cooperation with a first inner rod, a lower end of the first inner rod is configured to be mounted in cooperation with the lower disc assembly, and the elastic member is configured to be in a latching engagement with the lock groove.

The lower disc assembly is hingedly provided with a button member. The button member is movable against the elastic member, and may cause the elastic member to be unlocked from the lock groove.

The outer lock rod is further provided with a pre-pressing groove. The pre-pressing groove is configured to be mounted in cooperation with the elastic member, and the pre-pressing groove is located on an axially movable travel line of the elastic member.

In the disclosure, by optimization of the design, a plurality of self-lock unit structures are provided, especially the combination design of self-lock unit and lower disc assembly, so that the locking or unlocking of the lock rod assembly may be completed, which simplifies the structure of the self-lock unit and facilitates the assembly and installation of the self-lock unit. Furthermore, the structure design of the elastic member is preferred, so that the locking and the resetting property of the elastic member itself may be used to simplify the installation structure of the self-lock unit with the lock rod assembly, and to also achieve locking or unlocking of the lock rod assembly In summary, in the disclosure, by optimizing the structure of the self-lock unit, the product is facilitated in installation, the production cost is reduced and the product processing is facilitated.

The features of the present invention can be clearly understood from the description of the drawings and the detailed description of the preferred embodiments.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
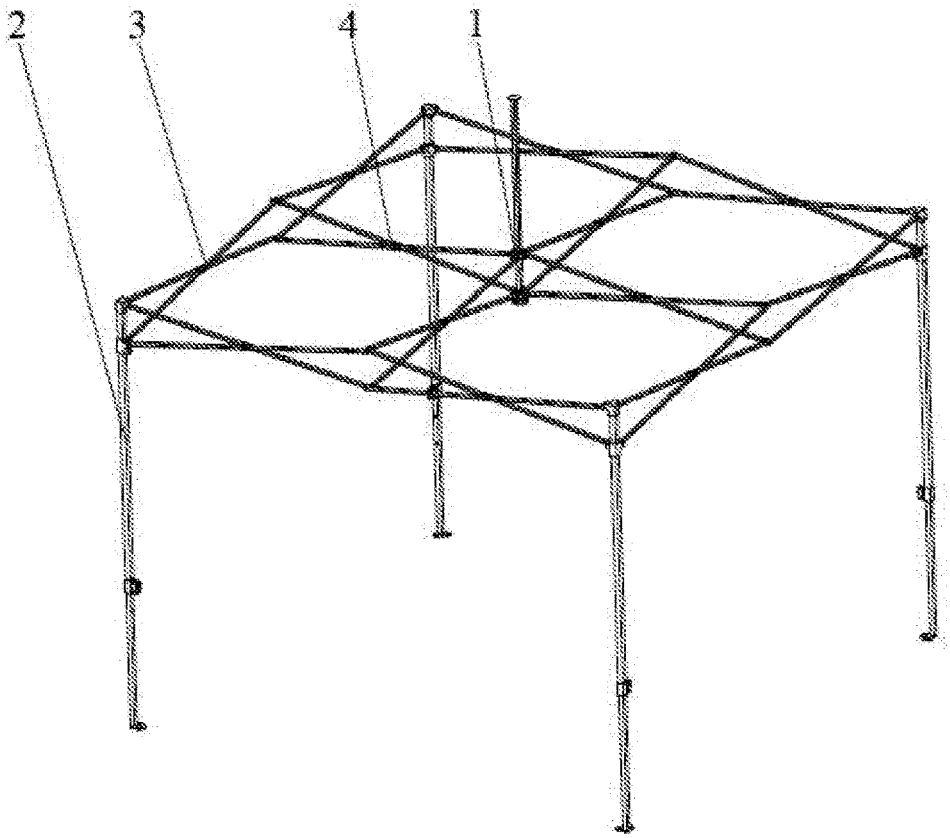
FIG. 1 is a structural diagram of the overall unfolded state of the present disclosure.

In order to make the technical means, creative features, achievement goals and effects achieved by the present invention easy to understand, the present invention will be further described below in conjunction with specific illustrations.

It should be noted that all directional indications (such as up, down, left, right, front, back, . . . ) in the embodiments of the present disclosure are only used to explain the relative positional relationship, motion situation and the like between components in a certain posture (as shown in the drawings), if the specific posture changes, the directional indication shall also change accordingly. In addition, the descriptions of "first", "second" and the like in the present disclosure are used for the purpose of description only, and are not to be construed as indicating or implying their relative importance or implicitly indicating the number of technical features indicated. Thus, features defined with "first", "second" may include at least one such feature, either explicitly or implicitly.

Embodiment 1

Figure 2:
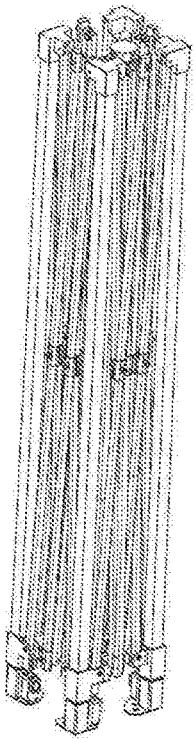
FIG. 2 is a structural diagram of the overall retracted state of the present invention.
Figure 3:
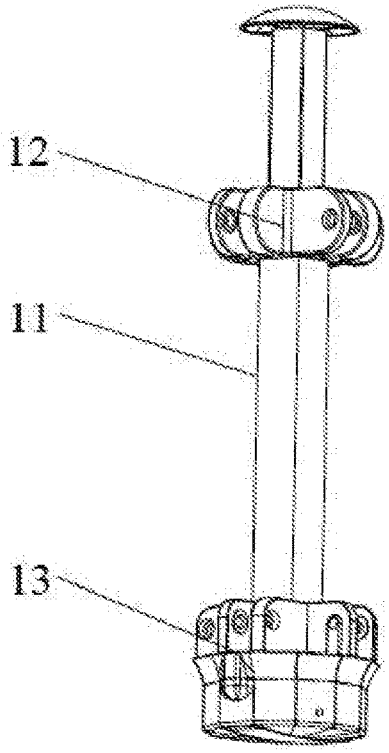
FIG. 3 is a structural diagram showing a locked state of a central self-lock mechanism in Embodiment 2 of the present disclosure.
Figure 4:
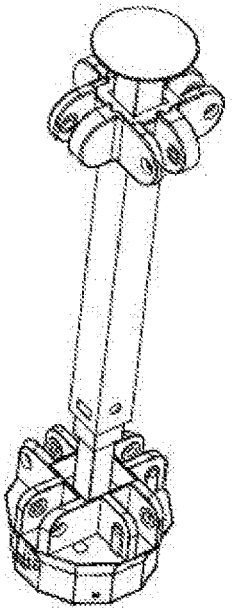
FIG. 4 is a structural diagram showing an unlocked state of the central self-lock mechanism in Embodiment 2 of the present disclosure.
Figure 5:
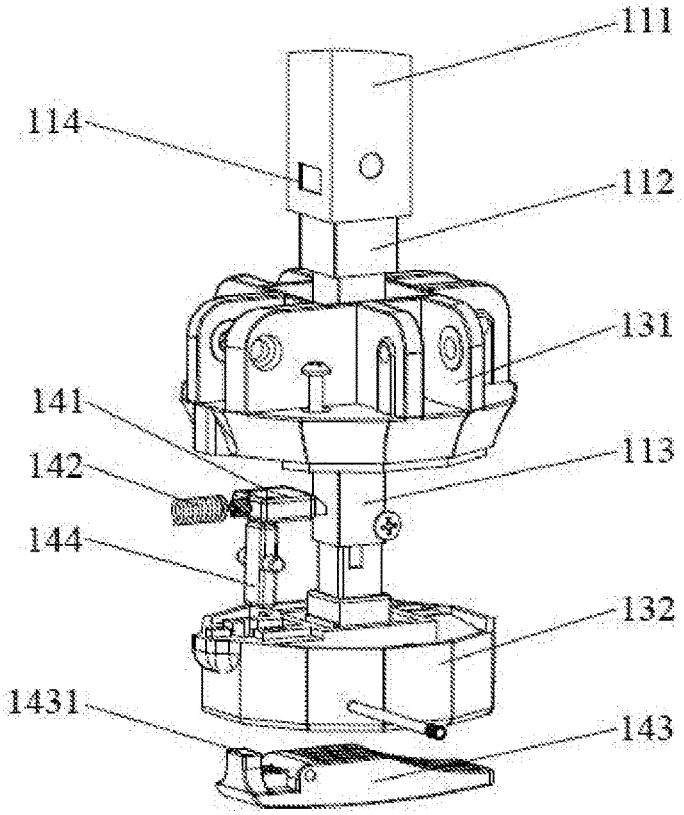
FIG. 5 is an exploded diagram of the central self-lock mechanism in Embodiment 2 of the present disclosure.
Figure 6:
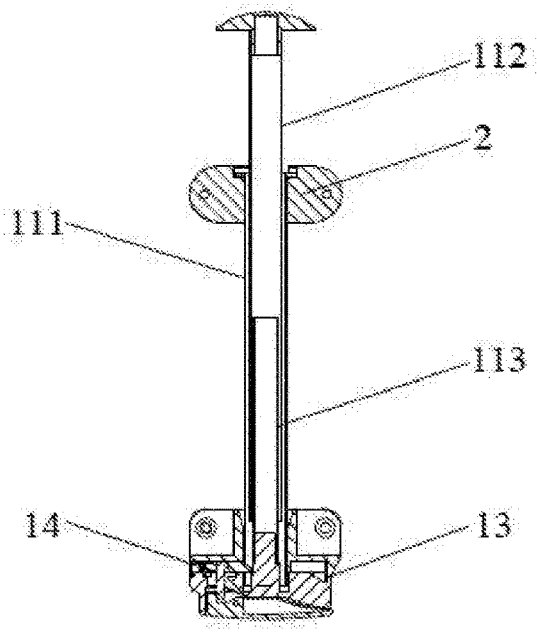
FIG. 6 is a section diagram of the central self-lock mechanism in Embodiment 2 of the present disclosure.
Figure 7:
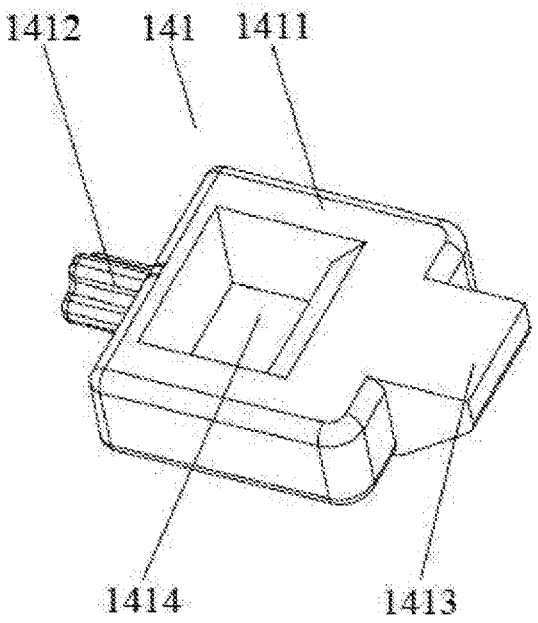
FIG. 7 is a section diagram of a lock tab in Embodiment 2 or 3 of the present disclosure.
Figure 8:
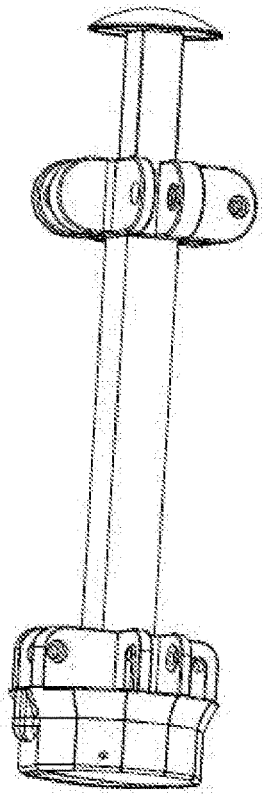
FIG. 8 is a structural diagram showing a locked state of a central self-lock mechanism in Embodiment 3 of the present disclosure.
Figure 9:
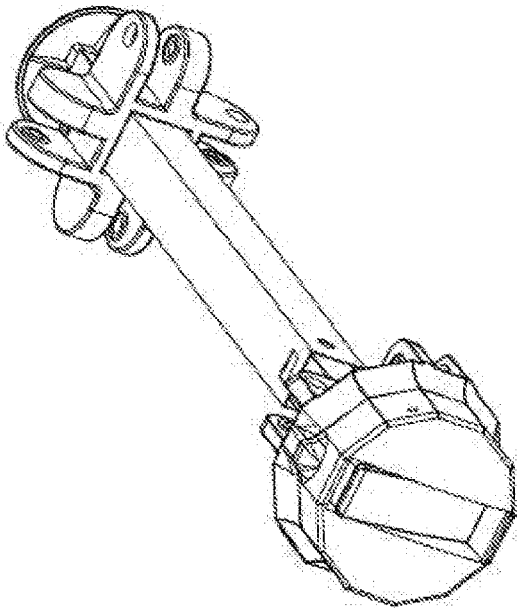
FIG. 9 is a structural diagram showing an unlocked state of the central self-lock mechanism by pressing in Embodiment 3 of the present disclosure.
Figure 10:
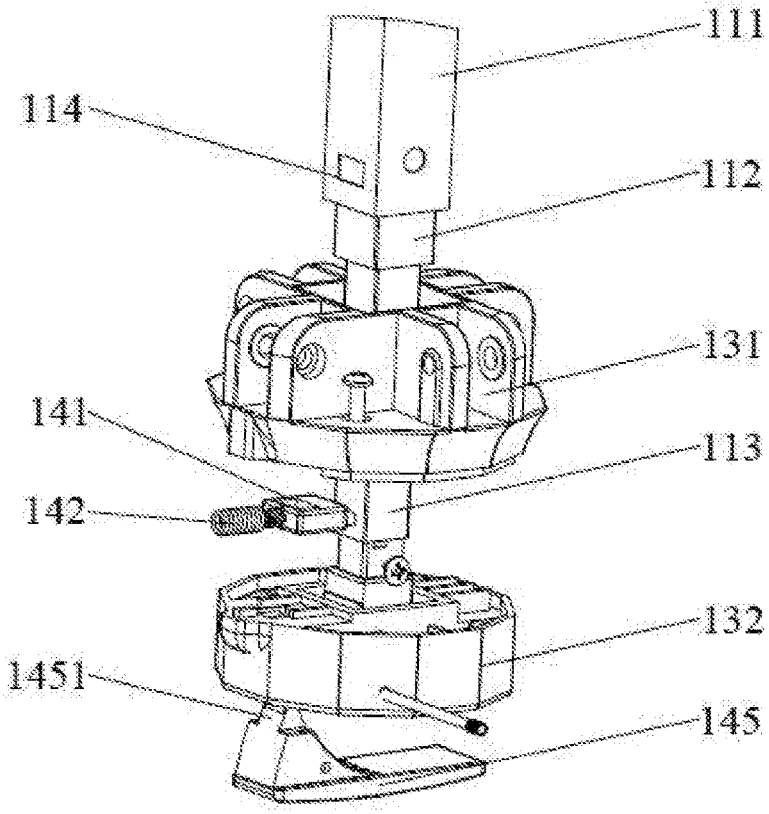
FIG. 10 is an exploded diagram of the central self-lock mechanism in Embodiment 3 of the present disclosure.
Figure 11:
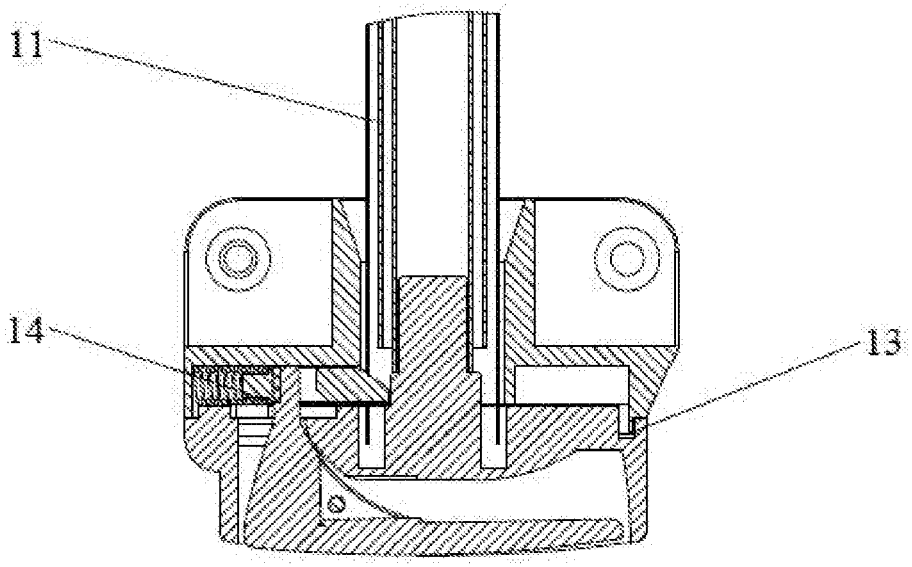
FIG. 11 is a section diagram of the central self-lock mechanism in Embodiment 3 of the present disclosure.
Figure 12:
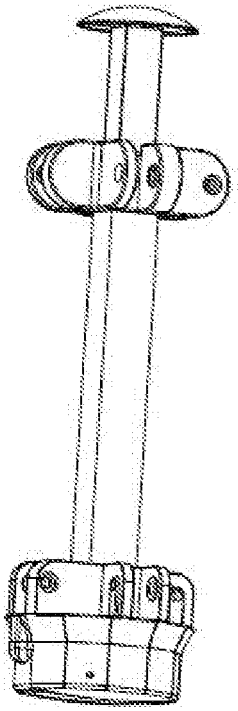
FIG. 12 is a structural diagram showing a locked state of a central self-lock mechanism in Embodiment 4 of the present disclosure.
Figure 13:
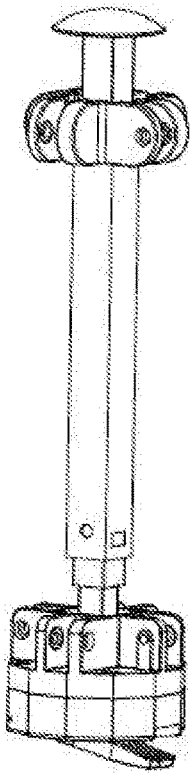
FIG. 13 is a structural diagram showing an unlocked state of the central self-lock mechanism in Embodiment 4 of the present disclosure.
Figure 14:
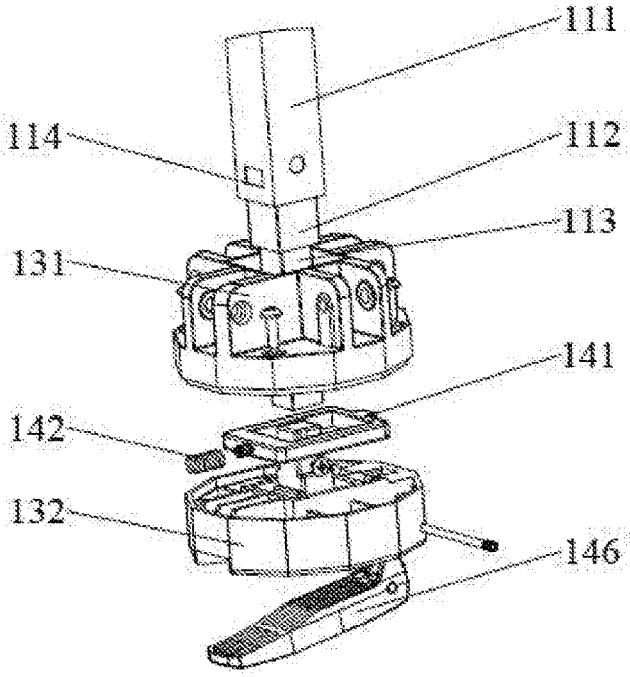
FIG. 14 is an exploded diagram of the central self-lock mechanism in Embodiment 4 of the present disclosure.
Figure 15:
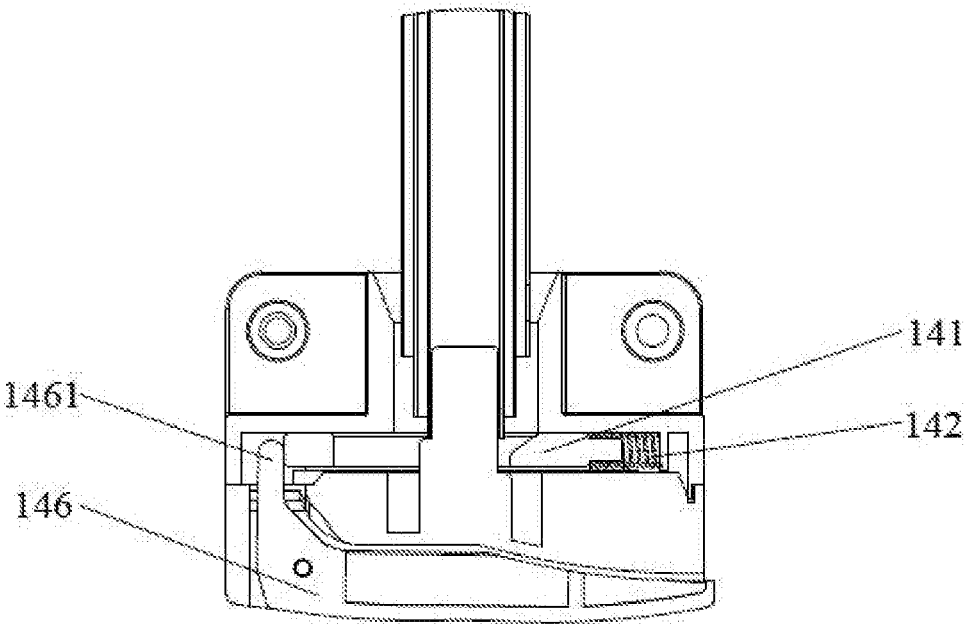
FIG. 15 is a section diagram of the central self-lock mechanism in Embodiment 4 of the present disclosure.
Figure 16:
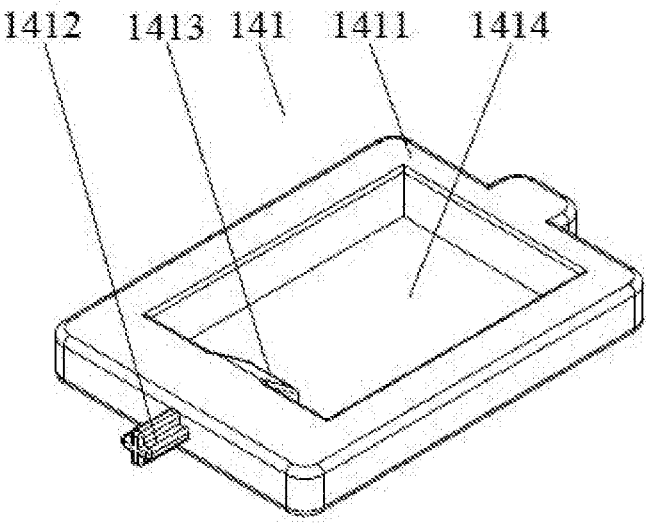
FIG. 16 is a structural diagram of a lock tab in Embodiment 4 of the present disclosure.
Figure 17:
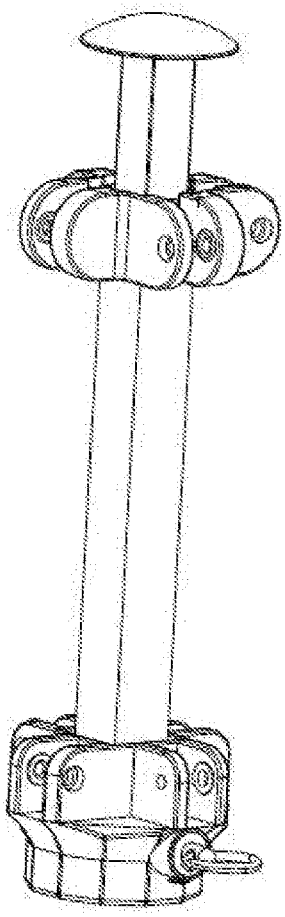
FIG. 17 is a structural diagram showing a locked state of a central self-lock mechanism in Embodiment 5 of the present disclosure.
Figure 18:
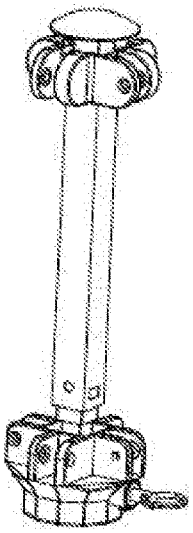
FIG. 18 is a structural diagram showing an unlocked state of the central self-lock mechanism in Embodiment 5 of the present disclosure.
Figure 19:
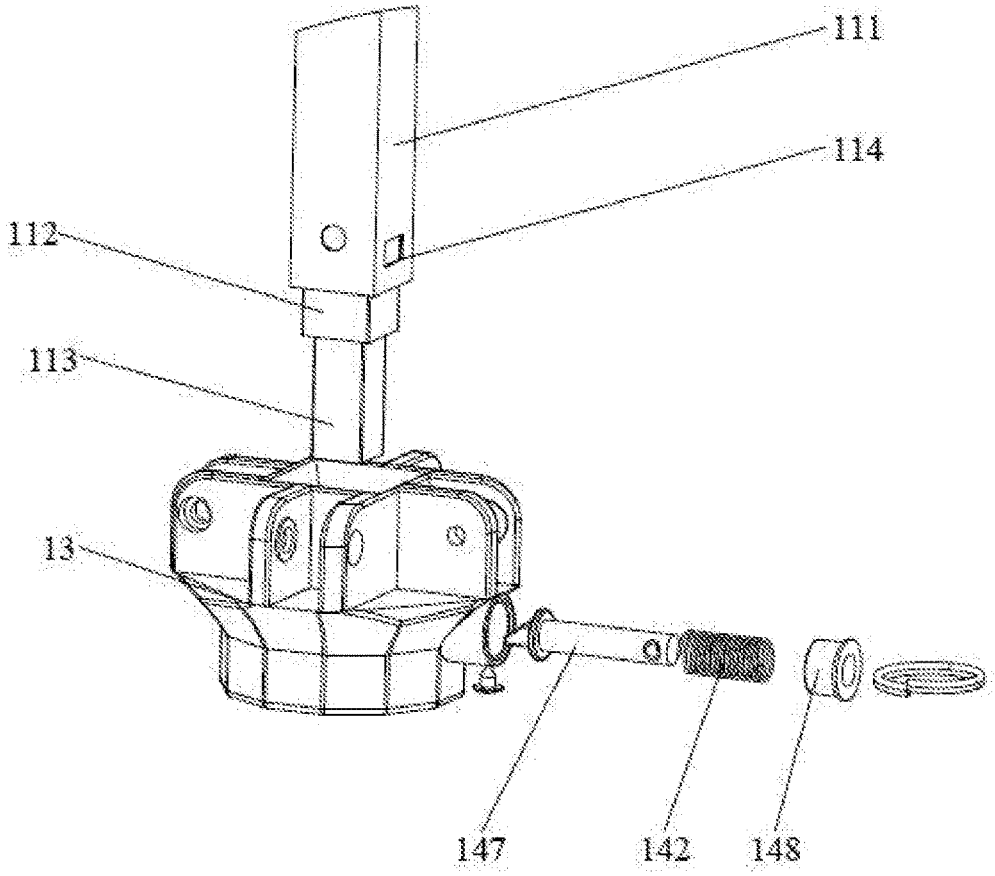
FIG. 19 is an exploded diagram of the central self-lock mechanism in Embodiment 5 of the present disclosure.
Figure 20:
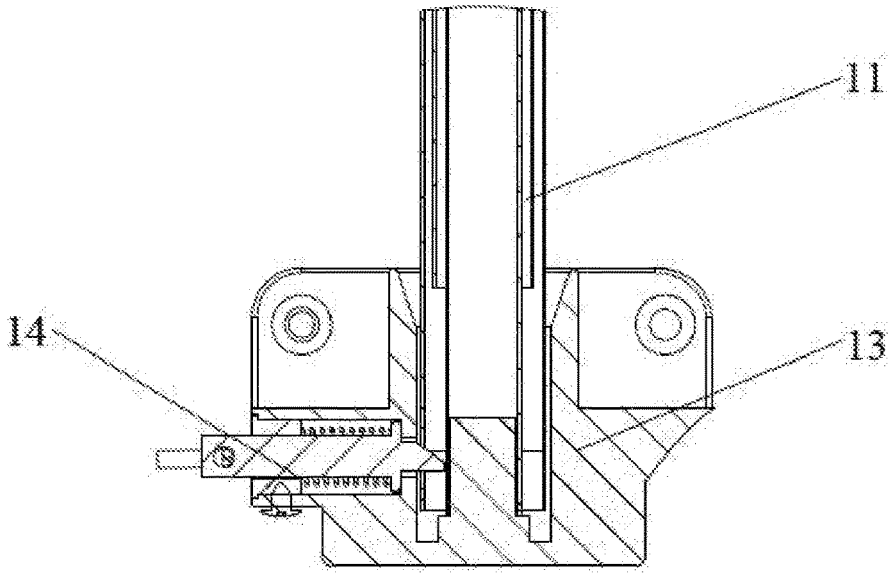
FIG. 20 is a section diagram of the central self-lock mechanism in Embodiment 5 of the present disclosure.
Figure 21:
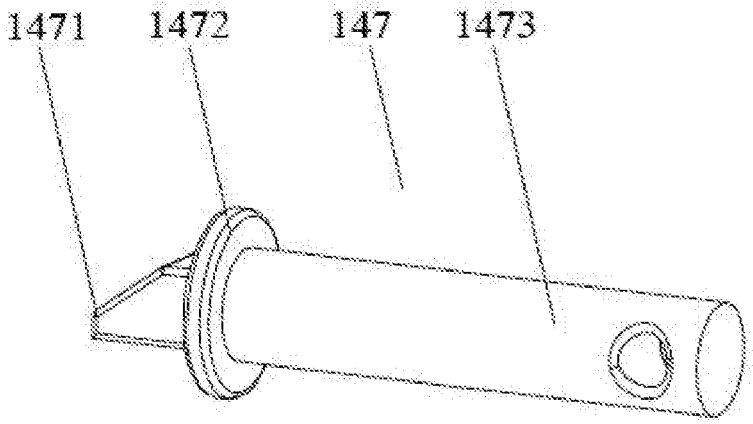
FIG. 21 is a structural diagram of a lock pin in Embodiment 5 of the present disclosure.
Figure 22:
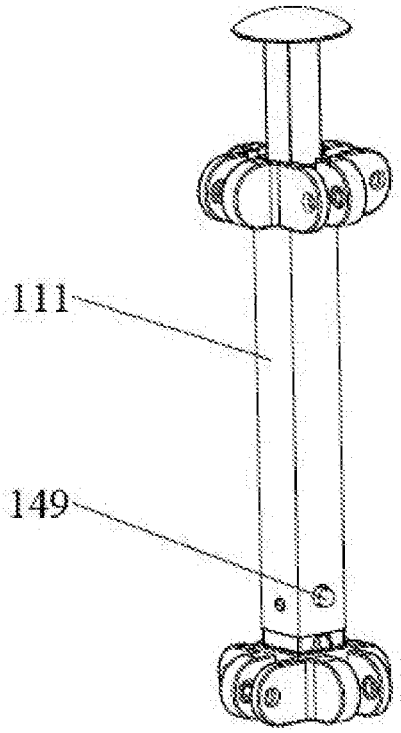
FIG. 22 is a structural diagram showing a locked state of a central self-lock mechanism in Embodiment 6 of the present disclosure.
Figure 23:
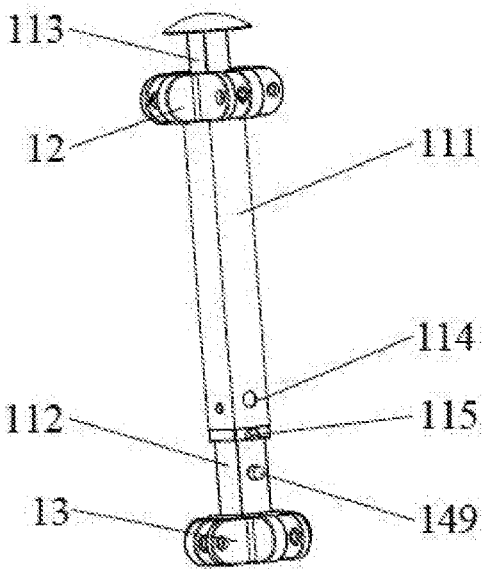
FIG. 23 is a structural diagram showing an unlocked state of the central self-lock mechanism in Embodiment 6 of the present disclosure.
Figure 24:
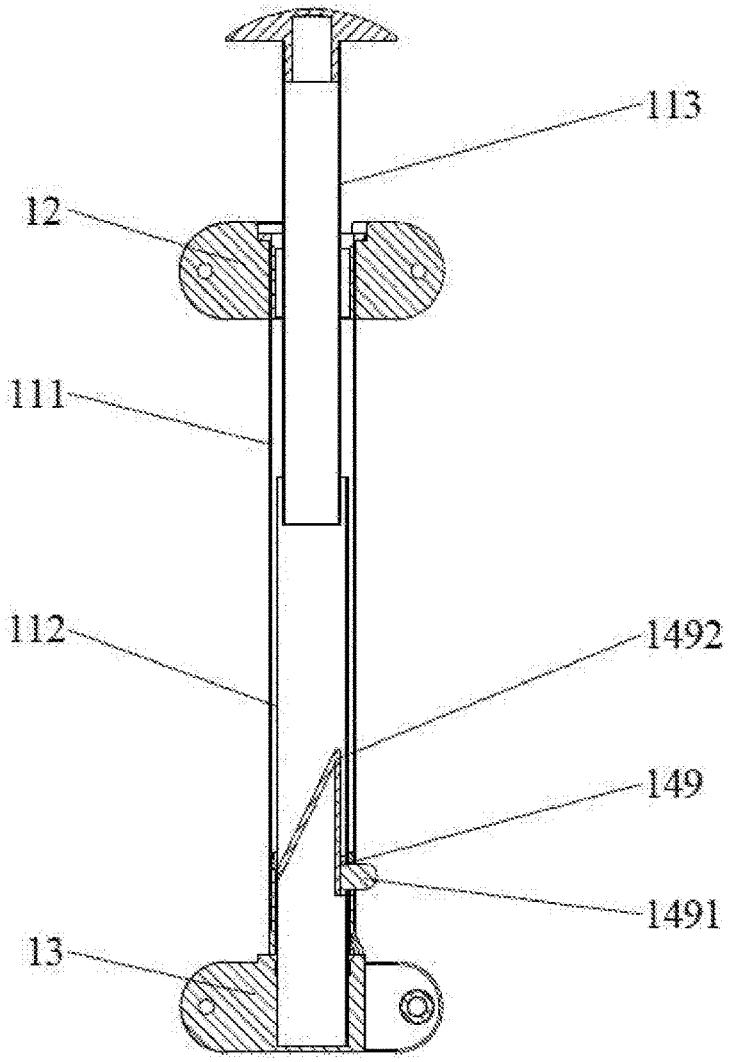
FIG. 24 is a section diagram of the central self-lock mechanism in Embodiment 6 of the present disclosure.
Figure 25:
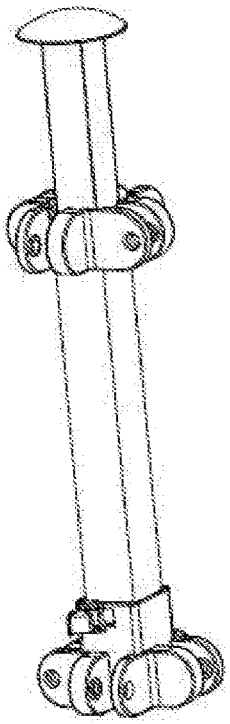
FIG. 25 is a structural diagram showing a locked state of a central self-lock mechanism in Embodiment 7 of the present disclosure.
Figure 26:
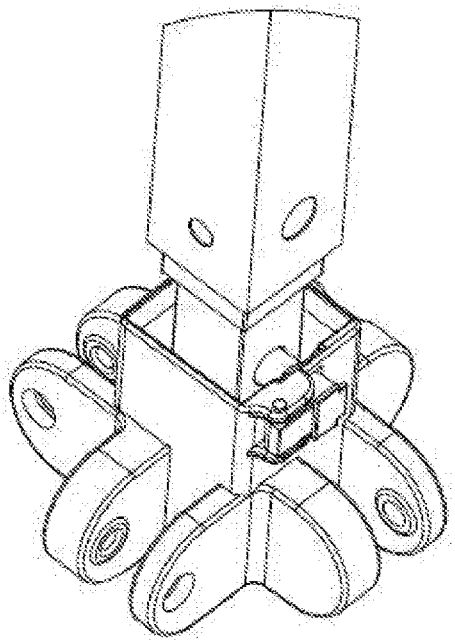
FIG. 26 is a structural diagram showing an unlocked state of the central self-lock mechanism in Embodiment 7 of the present disclosure.
Figure 27:
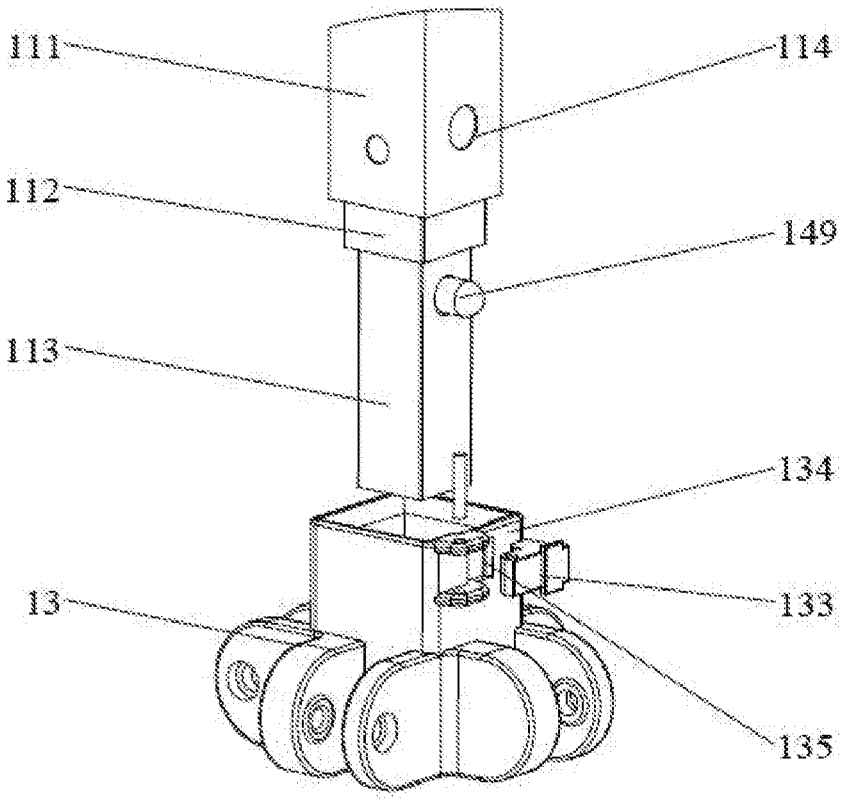
FIG. 27 is an exploded diagram of the central self-lock mechanism in Embodiment 7 of the present disclosure.
Figure 28:
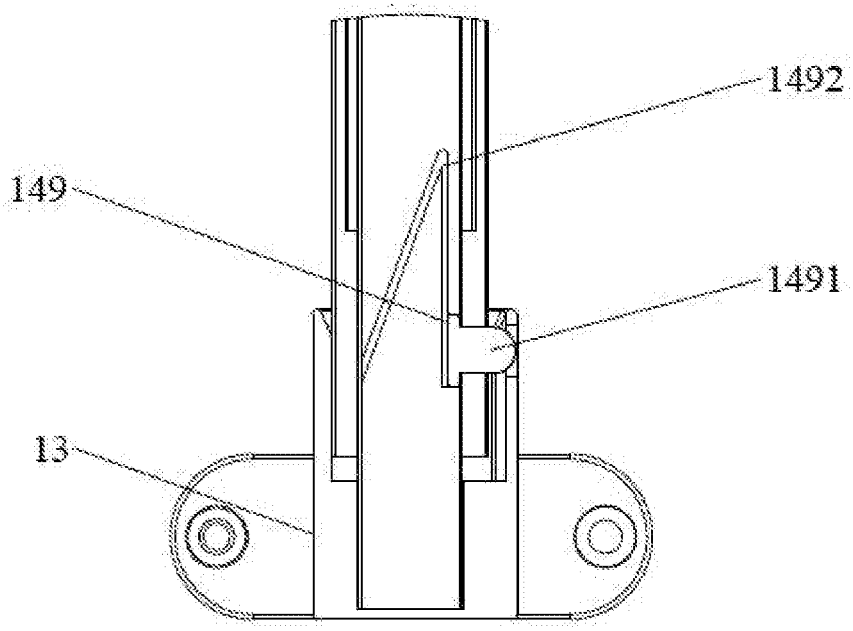
FIG. 28 is a section diagram of the central self-lock mechanism in Embodiment 7 of the present disclosure.

As shown in FIG. 1 and FIG. 2, the present disclosure provides a folding tent with central self-lock structure including a plurality of tent leg tubes 2, a plurality of side cross units 3, a plurality of middle cross units 4 and at least one central self-lock mechanism 1. The central self-lock mechanism 1 is configured to be installed in cooperation with one end of the middle cross units 4, and the central self-lock mechanism 1 comprises a lock rod assembly 11, a self-lock unit 14, an upper disc member 12 and a lower disc assembly 13. The lock rod assembly 11 is in a telescopic rod structure. When the folding tent is in an unfolded state, the self-lock unit 14 and the lock rod assembly 11 are locked, and a spacing between the upper disc member 12 and the lower disc assembly 13 is the smallest. When the folding tent is in a retracted state, the self-lock unit 14 and the lock rod assembly 11 are unlocked, the lock rod assembly 11 is telescopic, and the spacing between the upper disc member 12 and the lower disc assembly 13 gradually increases with the retraction.

Preferably, a number of the tent leg tube 2 is 4, but the number of the tent leg tube 2 is not limited to 4, such as a polygonal full-cross tent disclosed in Chinese Patent No. CN204475966U. A number of side cross units 3 is usually the same as the number of the tent leg tubes 2, preferably 4. A number of middle cross units 4 is usually the same as the number of side cross units 3, preferably 4. Both ends of the side cross unit 3 are respectively configured to be hingedly engagement with the tent leg tube 2. The middle cross unit 4 has one end configured to be hingedly engagement with the tent leg tube 2 or to be hingedly engagement with the middle of the side cross unit 3, and the other end configured to be hingedly engagement with the central self-lock mechanism 1.

Preferably, the lock rod assembly 11 includes an outer lock rod 111, a first inner rod 112 and a second inner rod 113. A lower portion of the outer lock rod 111 is provided with a lock groove 114, and the first inner rod 112 and the second inner rod 113 may perform a telescopic movement relative to the outer lock rod 111. The outer lock rod 111 is sleeved on an outer side of the first inner rod 112 or the second inner rod 113, and the first inner rod 112 is sleeved on an outer side of the second inner rod 113 or the second inner rod 113 is sleeved on the outer side of the first inner rod 112. The outer lock rod 111, the first inner rod 112 and the second inner rod 113 may be made of a square tube, a regular polygonal tube or a round tube with a hollow structure inside.

Preferably, an upper portion of the outer lock rod 111 is fixedly mounted with the upper disc member 12, and the upper disc member 12 is generally a plastic member and is provided with a plurality of hinge seats configured to be hingedly engaged with the tube members in the middle cross unit 4, which is commonly seen in the existing folding tent. The upper disc member 12 is sleeved on the outer lock rod 111, preferably on a top end of the outer lock rod 111.

Embodiment 2

As shown, based on Embodiment 1, in the present embodiment, the self-lock unit 14 is configured to be mounted in cooperation with the lower disc assembly 13 to integrate the self-lock unit 14 and the lower disc assembly 13, so as to facilitate installation of the self-lock unit 14, and to simplify the structures of the self-lock unit 14 and the lock rod assembly 11 while facilitating the locking or unlocking of the lock rod assembly 11.

Among them, preferably, the self-lock unit 14 includes a lock tab 141, a return spring 142, a driving pin 144 and a trigger 143. The trigger 143 is hingedly engaged with the lower disc assembly 13, and one end of the trigger 143 is movable against the driving pin 144. An upper end of the driving pin 144 is engaged with the lock tab 141, and the return spring 142 is configured to act on the lock tab 141. The driving pin 144 is hingedly engaged with the lower disc assembly 13.

Among them, the lower disc assembly 13 includes a first lower disc 131 and a second lower disc 132. The first lower disc 131 and the second lower disc 132 are assembled up and down with an inside formed with a cavity structure configured to mount the lock tab 141, the return spring 142, the driving pin 144 and the trigger 143. The trigger 143 is hingedly engaged with the second lower disc 132 through a pin shaft, and the trigger 143 may also be hingedly engaged with the second lower disc 132 by providing hinged protruding shafts on both sides. The trigger 143 is located at a bottom portion of the second lower disk 132 and is relatively embedded in the second lower disk 132. One end of the trigger 143 may be conveniently pulled by a user, and the other end of the trigger is provided with an abutment block 1431 configured to abut against the driving pin 144. The driving pin 144 is preferably a columnar structure, and the driving pin 144 is preferably hingedly engaged with the second lower disc 132, and may also be hingedly engaged with the first lower disc 131. Both ends of the driving pin 144 are radially extended with a hinged convex shaft to facilitate the hinged engagement with the second lower disc 132, or the hinged cooperation may be realized by penetrating the pin shaft. The upper end of the driving pin 144 is configured to be cooperated with the lock tab 141. The lock tab 141 includes a lock tab body 1411, a lock tongue 1413, a spring pin 1412 and a stroke hole 1414. The lock tongue 1413 is configured to cooperate with the lock groove 114 on the outer lock rod 111, and the return spring 142 has one end that cooperates with the spring pin 1412 and the other end that abuts against a cavity wall in the first lower disk 131 or/and the second lower disk 132. The upper end of the driving pin 144 is inserted into the stroke hole 1414, so as to realize the positional movement of the lock tab 141.

Among them, in the lock rod assembly 11, a lower end of the second inner rod 113 is fixedly mounted with the lower disc assembly 13. When the folding tent is fully retracted, an upper end of the second inner rod 113 is disengaged from the first inner rod 112 or the upper end of the second inner rod 113 is butted at a lower end of the first inner rod 112. During the deployment of the folding tent, the butting nature of telescopic rod, i.e., the first inner rod 112 and the second inner rod 113, facilitates the locking positioning of the self-lock unit 14 and improves the locking stability and accuracy.

In the present embodiment, the principle for locking or unlocking is as follows. When unlocking is required, the user pulls the trigger 143 downward, the trigger 143 utilizes the hinged structure, and the other end is swayed so that the abutment block 1431 in the trigger 143 is in contact with a lower end of the driving pin 144 so as to offset a lower portion of the driving pin 144 toward an inner center. Then, since the hinged position of the drive pin 144 is preferably in the middle, the lower portion of the driving pin 144 is offset inwardly such that the upper end of the driving pin 144 is outwardly offset, and the upper end of the driving pin 144 is in contact with a wall of the stroke hole 1414, thereby pushing the lock tab body 1411 outward, so that the lock tongue 1413 is disengaged from the lock groove 114. And then, the return spring 142 is compressed and deformed by the force, so after the lock tongue 1413 is completely disengaged from the lock groove 114, the user pulls down the lower disk assembly 13 so that the lower disk assembly 13 is separated from the outer lock rod 111, and when the lower disc assembly 13 continues away from the upper disc member 12, the folding tent gradually completes the overall folding. When locking is required, the folding tent is turned from folding to unfolding, and as the lower disc assembly 13 moves continuously upward, the lock tongue 1413 is forced against an outer side wall of the outer lock rod 111 by a force provided by the return spring 142 when the outer lock rod 111 is inserted into the lock cavity at a center of the first lower disc 131. Then, when the lock groove 114 in the outer lock rod 111 is at the same level as the lock tongue 1413, the lock tongue 1413 is subjected to the force of the return spring 142, so that the lock tongue 1413 is inserted into the lock groove 114 to realize the locking, at which time the folding tent is in a fully unfolded state.

Embodiment 3

As shown, based on Embodiment 1, in the present embodiment, the self-lock unit 14 is configured to be mounted in cooperation with the lower disc assembly 13 to integrate the self-lock unit 14 and the lower disc assembly 13, so as to facilitate installation of the self-lock unit 14, and to simplify the structures of the self-lock unit 14 and the lock rod assembly 11 while facilitating the locking or unlocking of the lock rod assembly 11.

Among them, preferably, the self-lock unit 14 includes the lock tab 141, the return spring 142 and a pressing plate 145. The trigger 145 is hingedly engaged with the lower disc assembly 13, and one end of the pressing plate 145 is movable against the lock tab 141. The return spring 142 is configured to act on the lock tab 141.

Among them, the lower disc assembly 13 includes the first lower disc 131 and the second lower disc 132, and the first lower disc 131 and the second lower disc 132 are assembled up and down with an inside formed with a cavity structure configured to mount the lock tab 141, the return spring 142 and the pressing plate 145. The pressing plate 145 is hingedly engaged with the second lower disc 132 through a pin shaft, and the pressing plate 145 may also be hingedly engaged with the second lower disc 132 by providing hinged protruding shafts on both sides. The pressing plate 145 is located at the bottom portion of the second lower disk 132 and is relatively embedded in the second lower disk 132. The pressing plate 145 may be conveniently pressed by the user, and the other end of a pressing portion of the pressing plate 145 is provided with a pushing plate 1451. The lock tab 141 includes the lock tab body 1411, the lock tongue 1413, the spring pin 1412 and the stroke hole 1414. The lock tongue 1413 is configured to cooperate with the lock groove 114 on the outer lock rod 111, and the return spring 142 has one end that cooperates with the spring pin 1412 and the other end that abuts against a cavity wall in the first lower disk 131 or/and the second lower disk 132. An upper end of the pushing plate 1451 is inserted into the stroke hole 1414, so as to realize the positional movement of the lock tab 141.

Compared with Embodiment 2, in the present embodiment, the triggering structure of the trigger 143 is changed to the pressing structure of the pressing plate 145, and the driving pin 144 is replaced with the pushing plate 1451, so that the positional movement of the lock tab 141 is realized.

Among them, in the lock rod assembly 11, the lower end of the second inner rod 113 is fixedly mounted with the lower disc assembly 132. When the folding tent is fully retracted, the upper end of the second inner rod 113 is disengaged from the first inner rod 112 or the upper end of the second inner rod 113 is butted at the lower end of the first inner rod 112. During the deployment of the folding tent, the butting nature of telescopic rod, i.e., the first inner rod 112 and the second inner rod 113, facilitates the locking positioning of the self-lock unit 14 and improves the locking stability and accuracy.

In the present embodiment, the principle for locking or unlocking is as follows. When unlocking is required, a user press the pressing plate 145 upward, the pressing plate 145 utilizes the hinged structure, and the other end is swayed so that the pushing plate 1451 in the pressing plate 145 is in contact with the wall of the stroke hole 1414. Then, since one end of the pressing plate 145 moves upward, the pushing plate 1451 on the other end moves outward relatively such that the lock tab body 1411 is outwardly moved, so that the lock tongue 1413 is disengaged from the lock groove 114. And then, the return spring 142 is compressed and deformed by the force, so as the lock tongue 1413 is completely disengaged from the lock groove 114, the user pulls down the lower disk assembly 13 so that the lower disk assembly 13 is separated from the outer lock rod 111, and when the lower disc assembly 13 continues away from the upper disc member 12, the folding tent gradually completes the overall folding. When locking is required, the folding tent is turned from folding to unfolding, and as the lower disc assembly 13 moves continuously upward, the lock tongue 1413 is forced against an outer side wall of the outer lock rod 111 by a force provided by the return spring 142 when the outer lock rod 111 is inserted into the lock cavity at the center of the first lower disc 132. Then, when the lock groove 114 in the outer lock rod 111 is at the same level as the lock tongue 1413, the lock tongue 1413 is subjected to the force of the return spring 142, so that the lock tongue 1413 is inserted into the lock groove 114 to realize the locking, at which time the folding tent is in a fully unfolding state.

Embodiment 4

As shown, based on Embodiment 1, in the present embodiment, the self-lock unit 14 is configured to be mounted in cooperation with the lower disc assembly 13 to integrate the self-lock unit 14 and the lower disc assembly 13, so as to facilitate installation of the self-lock unit 14, and to simplify the structures of the self-lock unit 14 and the lock rod assembly 11 while facilitating the locking or unlocking of the lock rod assembly 11.

Among them, preferably, the self-lock unit 14 includes the lock tab 141, the return spring 142 and a triggering plate 146. The triggering plate 146 is hingedly engaged with the lower disc assembly 13, and one end of the triggering plate 146 is movable against the lock tab 141. The return spring 142 is configured to act on the lock tab 141.

Among them, the lower disc assembly 13 includes the first lower disc 131 and the second lower disc 132. The first lower disc 131 and the second lower disc 132 are assembled up and down with an inside formed with a cavity structure configured to mount the lock tab 141, the return spring 142 and the pressing plate 146. The triggering plate 146 is hingedly engaged with the second lower disc 132 through a pin shaft, and the triggering plate 146 may also be hingedly engaged with the second lower disc 132 by providing hinged protruding shafts on both sides. The triggering plate 146 is located at the bottom portion of the second lower disk 132 and is relatively embedded in the second lower disk 132. The triggering plate 146 may be conveniently triggered by the user, and the other end of a triggering portion of the triggering plate 146 is provided with a pushing block 1461. The lock tab 141 includes the lock tab body 1411, the lock tongue 1413, the spring pin 1412 and the stroke hole 1414. The lock tongue 1413 is configured to cooperate with the lock groove 114 on the outer lock rod 111, and the return spring 142 has one end that cooperates with the spring pin 1412 and the other end that abuts against a cavity wall in the first lower disk 131 or/and the second lower disk 132. An upper end of the pushing block 1461 may be abut to act on an outer wall at one end of the lock tab body 1411 for moving the lock tab body 1411, and the lock tongue 1413 is on an inner wall of the stroke hole 1414. The outer lock rod 111 may penetrate up and down along the stroke hole 1414.

Compared with Embodiment 3, in the present embodiment, the action of the triggering plate 146 is changed from the original pressing 145 to the pulling action, and is designed as a structure of downwardly triggering, wherein it is operated similarly to the structure of the trigger 143 in Embodiment 1, i.e., acting directly on the lock tab 141 by using the pushing block 1461 so as to realize the positional movement of the lock tab 141. The structure in the present embodiment characterized by using the lock tongue 1413 in the stroke hole 1414 to use the pushing block 1461 to act on the outer wall of the lock tab 141 so as to realize unlocking of the lock tongue 1413 with the lock groove 114.

Among them, in the lock rod assembly 11, the lower end of the second inner rod 113 is fixedly mounted with the lower disc assembly 13. When the folding tent is fully retracted, the upper end of the second inner rod 113 is disengaged from the first inner rod 112 or the upper end of the second inner rod 113 is butted at a lower end of the first inner rod 112. During the deployment of the folding tent, the butting nature of telescopic rod, i.e., the first inner rod 112 and the second inner rod 113, facilitates the locking positioning of the self-lock unit 14 and improves the locking stability and accuracy.

In the present embodiment, the principle for locking or unlocking is as follows. When unlocking is required, a user triggers the triggering plate 146 downward, the triggering plate 146 utilizes the hinged structure, and the other end is swayed so that the pushing block 1461 in the triggering plate 146 is in contact with the outer wall on one end of the lock tab body 1411. Then, since one end of the triggering plate 146 moves downward, the pushing block 1461 on the other end moves outward relatively such that the lock tab body 1411 is inwardly moved, so that the lock tongue 1413 is disengaged from the lock groove 114; and then, the return spring 142 is compressed and deformed by the force, so as the lock tongue 1413 is completely disengaged from the lock groove 114, the user pulls down the lower disk assembly 13 so that the lower disk assembly 13 is separated from the outer lock rod 111, and when the lower disc assembly 13 continues away from the upper disc member 12, the folding tent gradually completes the overall folding. When locking is required, the folding tent is turned from folding to unfolding, and as the lower disc assembly 13 moves continuously upward, the lock tongue 1413 is forced against an outer side wall of the outer lock rod 111 by a force provided by the return spring 142 when the outer lock rod 111 is inserted into the lock cavity at the center of the first lower disc 132, and the outer lock rod 111 is located in the stroke hole 1414. Then, when the lock groove 114 in the outer lock rod 111 is at the same level as the lock tongue 1413, the lock tongue 1413 is subjected to the force of the return spring 142, so that the lock tongue 1413 is inserted into the lock groove 114 to realize the locking, at which time the folding tent is in a fully unfolded state.

Embodiment 5

As shown, based on Embodiment 1, in the present embodiment, the self-lock unit 14 is configured to be mounted in cooperation with the lower disc assembly 13 to integrate the self-lock unit 14 and the lower disc assembly 13, so as to facilitate installation of the self-lock unit 14, and to simplify the structures of the self-lock unit 14 and the lock rod assembly 11 while facilitating the locking or unlocking of the lock rod assembly 11.

Preferably, in the present embodiment, the self-lock unit 14 comprises a lock pin 147, the return spring 142 and a holder 148. The return spring 142 has one end in contact with the lock pin 147, and the other end in contact with the holder 148. The return spring 142 is deformed as the lock pin 147 moves, and the holder 148 is fixedly mounted with the lower disc assembly 13. One end of the lock pin 147 penetrates through the holder 148 and extends to an outside of the lower disk assembly 13.

Among them, the lower disc assembly 13 may be made of a unitary structure or a separate structure, and the separate structure refers to the structures of the corresponding lower disc assembly 13 in Embodiment 2, Embodiment 3 and Embodiment 4.

The lower disc assembly 13 is provided with a cavity configured to accommodate the lock pin 147, the return spring 142 and the holder 148. The lock pin 147 includes a lock tongue 1471, a spring holder 1472 and a lock pin body 1473. The lock pin body 1473 penetrates through the return spring 142. The return spring 142 has one end abutting against the spring holder 1472 and the other end abutting against the holder 148. The lock tongue 1471 is located inside the lower disc assembly 13, a portion of the lock pin body 1473 of the lock pin body 1473 away from the other end of the lock tongue 1471 penetrates through the holder 148 and extends to the outside of the lower disc assembly 13, and the lock pin body 1473 may perform a thrusting action with respect to the holder 148.

Preferably, an external portion of lock pin body 1473 is provided with a pull ring for the user to pull the lock pin; or an outer end of the lock pin body 1473 may be provided with a pulling handle.

Among them, in the lock rod assembly 11, the lower end of the second inner rod 113 is fixedly mounted with the lower disc assembly 13. When the folding tent is fully retracted, the upper end of the second inner rod 113 is disengaged from the first inner rod 112 or the upper end of the second inner rod 113 is butted at the lower end of the first inner rod 112. During the deployment of the folding tent, the butting nature of telescopic rod, i.e., the first inner rod 113 and the second inner rod 112, facilitates the locking positioning of the self-lock unit 14 and improves the locking stability and accuracy.

In the present embodiment, the principle for locking or unlocking is as follows. When unlocking is required, a user pulls the lock pin 147 outward, the lock tongue 1471 is outwardly moved, so that the lock tongue 1471 is disengaged from the lock groove 114. And then, the return spring 142 is compressed and deformed due to the limit from the spring holder 1472 and the holder 148, so as the lock tongue 1471 is completely disengaged from the lock groove 114, the user pulls down the lower disk assembly 13 so that the lower disk assembly 13 is separated from the outer lock rod 111, and when the lower disc assembly 13 continues away from the upper disc member 12, the folding tent gradually completes the overall folding. When locking is required, the folding tent is turned from folding to unfolding, and as the lower disc assembly 13 moves continuously upward, the lock tongue 1471 is forced against an outer side wall of the outer lock rod 111 by a force provided by the return spring 142 when the outer lock rod 111 is inserted into the lock cavity at the center of the lower disc assembly 13. Then, when the lock groove 114 in the outer lock rod 111 is at the same level as the lock tongue 1471, the lock tongue 1471 is subjected to the force of the return spring 142, so that the lock tongue 1471 is inserted into the lock groove 114 to realize the locking, at which time the folding tent is in a fully unfolding state.

Embodiment 6

As shown, based on Embodiment 1, in the present embodiment, the self-lock unit 14 is configured to be mounted in cooperation with the lock rod assembly 11, and the self-lock unit 14 is an elastic member 149. The elastic member 149 is mounted in cooperation with a first inner rod 112, the lower end of the first inner rod 112 is configured to be mounted in cooperation with the lower disc assembly 13, and the elastic member 149 is configured to be in a latching engagement with the lock groove 114.

Among them, the lock rod assembly 11 includes the outer lock rod 111, the first inner rod 112 and the second inner rod 113. The lower portion of the outer lock rod 111 is provided with the lock groove 114, and the first inner rod 112 and the second inner rod 113 may perform a telescopic movement relative to the outer lock rod 111. The outer lock rod 111 is sleeved on the outer side of the first inner rod 112, and the first inner rod 112 is sleeved on the outer side of the second inner rod 113.

Among them, in the lock rod assembly 11, the lower end of the first inner rod 112 is fixedly mounted with the lower disc assembly 13. When the folding tent is fully retracted, the upper end of the first inner rod 112 is disengaged from the second inner rod 113 or the upper end of the first inner rod 112 is butted at the lower end of the second inner rod 113. During the deployment of the folding tent, the butting nature of telescopic rod, i.e., the first inner rod 112 and the second inner rod 113, facilitates the locking positioning of the self-lock unit 14 and improves the locking stability and accuracy.

Among them, the elastic member 149 includes a spring portion 1491 and an elastic portion 1492. The spring portion 1491 protrudes from the first inner rod 112 and is configured to be in a latching cooperation with the lock groove 114.

In the present embodiment, the principle for locking or unlocking is as follows. When unlocking is required, a user presses the spring portion 1491 to make it move inward for being disengaged from the lock groove 114. And then, the elastic portion 1492 is deformed, so as the spring portion 1491 is completely disengaged from the lock groove 114, the user pulls down the lower disk assembly 13 so that the lower disk assembly 13 is separated from the outer lock rod 111, and when the lower disc assembly 13 continues away from the upper disc member 12, the folding tent gradually completes the overall folding. When locking is required, the folding tent is turned from folding to unfolding, and as the lower disc assembly 13 moves continuously upward, the first inner rod 112 continues to retract toward an inner cavity of the outer lock rod 111 when the first inner rod 112 and the second inner rod 113 achieve retraction or complete retraction for butting. Then, when the lock groove 114 in the outer lock rod 111 is at the same level as the spring portion 1491, the spring portion 1491 is subjected to the force of the elastic portion 1492, so that the lock spring portion 1491 is inserted into the lock groove 114 to realize the locking, at which time the folding tent is in a fully unfolded state.

Preferably, in order to make the spring portion 1491 enter the inner cavity of the outer lock rod 111 more smoothly, the outer lock rod 111 is further provided with a pre-pressing groove 115. The pre-pressing groove 115 is con figured to be mounted in cooperation with the elastic member 149, and the pre-pressing groove 115 is located on the axially movable stroke line of the elastic member 149.

Embodiment 7

As shown in combination of Embodiment 6, in the present embodiment, the lower disc assembly 13 is hingedly provided with a button member 133. The button member 133 is movable against the elastic member 149, and may cause the elastic member 149 to be unlocked from the lock groove 114.

The elastic member 149 is configured to be mounted on the second inner rod 113. In the lock rod assembly 11, the lower end of the second inner rod 113 is fixedly mounted with the lower disc assembly 13. When the folding tent is fully retracted, the upper end of the first inner rod 112 is disengaged from the second inner rod 113 or the upper end of the second inner rod 113 is butted at the lower end of the first inner rod 112. During the deployment of the folding tent, the butting nature of telescopic rod, i.e., the first inner rod 112 and the second inner rod 113, facilitates the locking positioning of the self-lock unit 14 and improves the locking stability and accuracy.

Among them, the elastic member 149 includes the spring portion 1491 and the elastic portion 1492. The spring portion 1491 protrudes from the second inner rod 113 and is configured to be in a latching cooperation with the lock groove 114.

Among them, the lower disc assembly 13 is provided with a lock seat 134, and the lock seat 134 has a cavity structure therein for facilitating the insertion of the lower end portion of the outer lock rod 111. The lock seat 134 is provided with an unlocking port 135. When the folding tent is in a fully controlled state, the unlocking port 135, the spring portion 1491, and the lock groove 114 are at the same horizontal plane. The button member 133 is located outside the unlocking port 135, so that when the user presses the button member 133, the button member 133 may be in contact with the spring portion 1491 to realize the disengagement of the spring portion 1491 from the lock groove 114.

Compared with Embodiment 6, the button member 133 is optimizedly configured, so that this structural design may prevent the user from directly acting on the spring portion 1491, thus the unlocking is relatively more convenient and effective while the operation is more convenient and comfortable.

The above description is only a preferred embodiment of the present invention, and is not intended to limit the present invention in any way. Any simple modifications, equivalent changes, or modifications made to the above embodiments in accordance with the technical principles of the present invention are still within the scope of the present invention.

What is claimed is:

1. A folding tent with central self-lock structure, comprising a plurality of tent leg tubes, a plurality of side cross units, a plurality of middle cross units and at least one central self-lock mechanism, wherein the central self-lock mechanism is configured to be installed in cooperation with one end of the middle cross units, and the central self-lock mechanism comprises a lock rod assembly, a self-lock unit, an upper disc member and a lower disc assembly, the lock rod assembly is in a telescopic rod structure; when the folding tent is in an unfolded state, the self-lock unit and the lock rod assembly are locked, and a spacing between the upper disc member and the lower disc assembly is the smallest; when the folding tent is in a retracted state, the self-lock unit and the lock rod assembly are unlocked, the lock rod assembly is telescopic, and the spacing between the upper disc member and the lower disc assembly gradually increases with the retraction, wherein the lock rod assembly comprises an outer lock rod, a first inner rod and a second inner rod, the outer lock rod is sleeved outside of the first inner rod and the second inner rod, a lower portion of the outer lock rod is provided with a lock groove, the first inner rod and the second inner rod perform a telescopic movement relative to the outer lock rod when the folding tent is converted between the unfolded state and the retracted state, and an upper portion of the outer lock rod is fixedly mounted with the upper disc member.

2. The folding tent with central self-lock structure according to claim 1, wherein the self-lock unit is configured to be mounted in cooperation with the lower disc assembly, and the self-lock unit comprises a lock tab, a return spring, a driving pin and a trigger; the trigger is hingedly engaged with the lower disc assembly, and one end of the trigger is movable against the driving pin; an upper end of the driving pin is engaged with the lock tab, and the return spring is configured to act on the lock tab.

3. The folding tent with central self-lock structure according to claim 2, wherein the driving pin is hingedly engaged with the lower disc assembly.

4. The folding tent with central self-lock structure according to claim 1, wherein the self-lock unit is configured to be mounted in cooperation with the lower disc assembly, and the self-lock unit comprises a lock tab, a return spring, and a pressing plate; the pressing plate is hingedly engaged with the lower disc assembly, and one end of the pressing plate is movable against the lock tab after being pressed upward; the return spring is configured to act on the lock tab.

5. The folding tent with central self-lock structure according to claim 1, wherein the self-lock unit is configured to be mounted in cooperation with the lower disc assembly, and the self-lock unit comprises a lock tab, a return spring, and a triggering plate; the triggering plate is hingedly engaged with the lower disc assembly, and one end of the triggering plate is movable against the lock tab after being triggered downward; the return spring is configured to act on the lock tab.

6. The folding tent with central self-lock structure according to claim 1, wherein the self-lock unit is configured to be mounted in cooperation with the lower disc assembly, and the self-lock unit comprises a lock pin, a return spring and a holder; the return spring has one end in contact with the lock pin, and the other end in contact with the holder; the return spring is deformed as the lock pin moves, and the holder is fixedly mounted with the lower disc assembly; one end of the lock pin penetrates through the holder and extends to an outside of the lower disk assembly.

7. The folding tent with central self-lock structure according to claim 1, wherein the self-lock unit is configured to be mounted in cooperation with the lock rod assembly, and the self-lock unit is an elastic member; the elastic member is mounted in cooperation with the first inner rod, a lower end of the first inner rod is configured to be mounted in cooperation with the lower disc assembly, and the elastic member is configured to be in a latching engagement with the lock groove.

8. The folding tent with central self-lock structure according to claim 7, wherein the lower disc assembly is hingedly provided with a button member; the button member is movable against an elastic member, such that the elastic member is unlocked from the lock groove.

9. The folding tent with central self-lock structure according to claim 8, wherein the outer lock rod is further provided with a pre-pressing groove; the pre-pressing groove is configured to be mounted in cooperation with the elastic member, and the pre-pressing groove is located on an axially movable travel line of the elastic member.

* * * * *